US011717765B2

(12) United States Patent
Su

(10) Patent No.: US 11,717,765 B2
(45) Date of Patent: Aug. 8, 2023

(54) BUILDING BLOCK DEVICE WITH 35 UNITS AS VARIABLE COMBINATIONS

(71) Applicant: Ping-Hung Su, New Taipei (TW)

(72) Inventor: Ping-Hung Su, New Taipei (TW)

(73) Assignee: Lonpos Braintelligent Co., Ltd, New Taipei (TW)

( * ) Notice: Subject to any disclaimer, the term of this patent is extended or adjusted under 35 U.S.C. 154(b) by 146 days.

(21) Appl. No.: 17/326,293

(22) Filed: May 20, 2021

(65) Prior Publication Data

US 2022/0370928 A1 Nov. 24, 2022

(51) Int. Cl.
*A63H 33/06* (2006.01)
*A63F 9/06* (2006.01)
*B65D 25/10* (2006.01)

(52) U.S. Cl.
CPC ..... *A63H 33/06* (2013.01); *B65D 25/10* (2013.01)

(58) Field of Classification Search
CPC ..... A63H 33/04; A63H 33/06; A63H 33/08; A63F 9/12; A63F 2003/0081; A63F 2009/1236; B65D 25/10
USPC ..... 446/85, 117, 118, 120, 124; 273/153 P, 273/156, 157 R, 276
See application file for complete search history.

(56) References Cited

U.S. PATENT DOCUMENTS 1,709,660 A * 4/1929 De Bracht ..... A63F 9/1204 273/157 R
3,945,645 A * 3/1976 Roberts ..... A63F 9/12 273/157 R
4,133,538 A * 1/1979 Ambrose ..... A63F 9/0073 273/287
4,173,833 A * 11/1979 Rosenblatt ..... G09B 3/02 434/236
4,257,609 A * 3/1981 Squibbs ..... A63F 9/12 273/276
4,988,103 A * 1/1991 Cheng ..... A63F 9/12 273/157 R
5,711,524 A * 1/1998 Bauer ..... A63F 3/00574 273/157 R
5,988,640 A * 11/1999 Wheeler ..... A63F 3/00574 273/290
6,220,919 B1 * 4/2001 Cheng ..... A63F 9/1288 273/156
6,702,285 B2 * 3/2004 Cheng ..... A63F 9/12 273/153 R
7,040,621 B2 * 5/2006 Cheng ..... G09B 1/02 273/157 R (Continued)

*Primary Examiner* — Alexander R Niconovich

(57) ABSTRACT

A building block device with 35 units as variable combinations, including a storage box and a building block group, the storage box comprises a base and a top cover covering the base, the building block group comprises multiple building blocks, the base has a storage tank for placing the building block group, the top cover can cover the base to conceal the building block group; the bottom of the storage tank is provided with 35 locating grids for the building block group to form a single-layer planar pattern, the surface of the top cover is provided with 15 locating slots for the building block group to stack up a five-layer trilateral cone, each building block of the building block group comprises one to five units, the units are connected at horizontally or vertically two-dimensional angles, the building block group has 35 units.

8 Claims, 11 Drawing Sheets

(56) References Cited

U.S. PATENT DOCUMENTS

| | | | | |
|---|---|---|---|---|
| 7,140,612 | B2 * | 11/2006 | Chen | A63F 9/1204 273/156 |
| 8,020,867 | B2 * | 9/2011 | Cheng | A63F 9/10 273/156 |
| 8,480,449 | B2 * | 7/2013 | Cheng | A63H 33/06 446/124 |
| 8,870,185 | B2 * | 10/2014 | Cheng | A63F 3/00003 273/281 |
| 9,295,904 | B2 * | 3/2016 | Vandoren | A63H 33/062 |
| 9,427,675 | B2 * | 8/2016 | Yang | A63H 33/04 |
| 9,744,473 | B2 * | 8/2017 | Yang | A63H 33/06 |
| 10,427,032 | B1 * | 10/2019 | Lin | A63F 3/04 |
| 10,453,357 | B2 * | 10/2019 | Su | A63F 9/12 |
| 11,491,414 | B2 * | 11/2022 | Bagley | A63H 33/082 |
| 2007/0187890 | A1 * | 8/2007 | Cheng | A63H 33/04 273/156 |
| 2008/0108274 | A1 * | 5/2008 | Cheng | A63H 33/065 446/120 |
| 2008/0274665 | A1 * | 11/2008 | Cheng | A63H 33/08 446/118 |
| 2010/0237561 | A1 * | 9/2010 | Cheng | A63F 9/10 273/157 R |
| 2010/0267308 | A1 * | 10/2010 | Huang | A63F 9/1204 446/85 |

* cited by examiner

BUILDING BLOCK DEVICE WITH 35 UNITS AS VARIABLE COMBINATIONS

BACKGROUND OF INVENTION

Field of the Invention

The present invention relates generally to the domain of intelligence toys, and more particularly to a building block device with multiple building block units as variable combinations.

Description of Related Art

The applicant has developed diversified intelligence toys, including a building block device in relation to stacking a three-dimensional pyramid shape out of multiple building blocks which can assemble flat patterns, e.g. the following patent document Taiwan patent numbers I370010, M528199, M372207, M320919 and M296735.

In previous case, multiple building block units must stack up a three-dimensional pyramid shape on a first base, or assemble a planar pattern shape on a second base, so two bases and multiple building blocks are required. However, a large packing box is required for storage, the packing box is large, occupying space and unlikely to be carried with, it is necessary to be improved.

The building block group in previous case comprises multiple building blocks, e.g. 8, 12 or 17 building blocks in different shapes, there is no building block group other than the three building block groups. For novelty and change, and to innovate in and enhance the fun of the game play, the design of building block group shall be innovated.

The building block group, the first base and the second base in previous case are manufactured by integrated injection molding through plastic molding, all of them are solids, consuming a lot of plastic materials, and they are heavy, with rising prices of plastic materials and environmental requirement, how to reduce the weight, the consumption of plastic materials and the manufacturing cost without losing the original functions of use is a topic to be overcome for the moment.

SUMMARY OF THE INVENTION

In order to solve the above-mentioned problems, the technical means of the present invention are realized by the following methods:

A building block device with 35 units as variable combinations, including a storage box and a building block group, wherein the storage box includes a base and a top cover covering the base; the building block group includes a plurality of building blocks, the base has a storage tank for placing the building block group, the top cover can cover the base to conceal the building block group; a bottom of the storage tank is provided with 35 locating grids for the building block group to form a single-layer planar pattern, a surface of the top cover is provided with 15 locating slots for the building block group to stack up a five-layer trilateral cone, each building block of the building block group includes one to five units, the units are connected at horizontally or vertically two-dimensional angles, the building block group has 35 units.

More particularly, wherein the building block unit of the building block group is cubic; the locating grid is square, it has a quadrate bottom; the locating slot is hexagonal, comprising a triangular bottom and three bevel faces surrounding the bottom.

More particularly, wherein the base is trilateral, there are ten rows of the locating grid from top to bottom, including one grid in the first row, two grids in the second row, three grids in the third row, two grids in the fourth row, three grids in the fifth row, four grids in the sixth row, five grids in the seventh row, four grids in the eighth row, five grids in the ninth row, and six grids in the tenth row, the grid edges of the upper and lower locating grids abut on each other at 45°, the grid corners of the left and right locating grids abut on each other at a horizontal angle.

More particularly, wherein the top cover is trilateral, each side is provided with five locating slots, there are five rows of locating slot from top to bottom, including one slot in the first row, two slots in the second row, three slots in the third row, four slots in the fourth row and five slots in the fifth row, the slot edges of the upper and lower locating slots abut on each other at 60°, the slot edges of left and right locating slots abut on each other at a horizontal angle.

More particularly, wherein the 35 building block units comprise nine building blocks, including: the first building block: building block of Unit 2; the second and third building blocks: building block of Unit 3; the fourth, fifth and sixth building blocks: building blocks of Unit 4; and the seventh, eighth and ninth building blocks: building blocks of Unit 5.

More particularly, wherein the 35 building block units comprise nine building blocks, including: the first building block: building block of Unit 1; the second building block: building block of Unit 2; the third, fourth and fifth building blocks: building blocks of Unit 4; and the sixth, seventh, eighth and ninth building blocks: building blocks of Unit 5.

More particularly, wherein the 35 building block units comprise nine building blocks, including: the first building block: building block of Unit 1; the second building block: building block of Unit 3; the third, fourth, fifth and sixth building blocks: building blocks of Unit 4; and the seventh, eighth and ninth building blocks: building blocks of Unit 5.

More particularly, wherein the 35 building block units comprise 10 building blocks, including: the first building block: building block of Unit 1; the second building block: building block of Unit 2; the third and fourth building blocks: building blocks of Unit 3; and the fifth, sixth, seventh and eighth building blocks: building blocks of Unit 4; and the ninth and tenth building blocks: building blocks of Unit 5.

More particularly, wherein the building blocks are selected from the following Units 1 to 5, including Unit 1; one piece, building block Unit 2: one piece, building block, Units 1 and 2 are horizontally connected; Unit 3: two pieces, including No. 1, building block, Units 1, 2 and 3 are horizontally connected; No. 2, building block, Units 1 and 2 are horizontally connected, Units 1 and 3 are vertically connected; Unit 4: five pieces, including No. 1, building block, Units 1, 2, 3 and 4 are horizontally connected; No. 2, building block, Units 1, 2 and 3 are horizontally connected, Units 2 and 4 are vertically connected; No. 3, building block, Units 1, 2 and 3 are horizontally connected, Units 1 and 4 are vertically connected; No. 4, building block, Units 1 and 2 are horizontally connected, Units 3 and 4 are horizontally connected, Units 1 and 4 are vertically connected; No. 5, building block, Units 1 and 2 are horizontally connected, Units 3 and 4 are horizontally connected; Units 1 and 3 are vertically connected, Units 2 and 4 are vertically connected; Unit 5: nine pieces, including: No. 1, building block, Units 1, 2, 3, 4 and 5 are horizontally connected; No. 2, building block, Units 1, 2, 3 and 4 are horizontally connected, Units 2 and 5 are vertically connected; No. 3, building block, Units 1, 2, 3 and 4 are horizontally connected, Units 1 and 5 are vertically connected; No. 4, building block, Units 1, 2 and 3 are horizontally connected, Units 1, 4 and 5 are vertically connected; No. 5, building block, Units 1, 2 and 3 are horizontally connected, Units 4, 2 and 5 are vertically connected; No. 6, building block, Units 1 and 2 are horizontally connected, Units 3 and 4 are horizontally connected, Units 1 and 4 are vertically connected, Units 3 and 5 are vertically connected; No. 7, building block, Units 1, 2 and 3 are horizontally connected, Units 4 and 5 are horizontally connected, Units 1 and 5 are vertically connected; No. 8, building block, Units 1, 2 and 3 are horizontally connected, Units 2, 4 and 5 are vertically connected; No. 9, building block, Units 1, 2 and 3 are vertically connected, Units 4 and 5 are vertically connected, Units 1 and 4 are horizontally connected, Units 2 and 5 are horizontally connected.

More particularly, wherein the base is divided into an upper layer and a lower layer, the lower layer has larger outside diameter than the upper layer, presenting a step-like periphery, the lower layers of the first and second sides are connected to long convex edges, the lower layer of the third side forms a short notch, the two long convex edges are longer than the short notch; moreover, the shape of the top cover is identical with the base, the bottom edges of two sides are provided with long notches, the bottom edge of the other side is provided with a short notch, the two long notches are longer than the short notch; the bottom surface of the top cover coves to wrap the upper layer of base, and the bottom edge can be put on the top edge of lower layer of base, the two long notches of top cover can match the two long convex edges of base without gaps, the short notch and the short notch of the base are vertically symmetrical to form an open gap.

In comparison to traditional one, the following benefits can be achieved by implementing the present invention:

The top cover and base of the present invention can be combined into a storage box for the building block group, the building block group can be stored to avoid losing building blocks, and in comparison to the traditional way using a packing box for storage, the production cost can be reduced, and the small box body occupies a little space, it is more portable. A foolproof structure is arranged between the top cover and base to avoid misplacing the top cover on the base.

The building block group of the present invention comprises 9 or 10 building blocks, different from prior combinations, so new plays and new solutions can be generated to enlighten the children's brain and enhance the interest in game.

The building block group, base and front cover are molded of plastic material, but the inside is hollow, different from prior solid structure, so the consumption of plastic material can be reduced, the manufacturing cost is reduced, and the weight is reduced a lot without losing the original function, con forming to environmental benefit.

DETAILED DESCRIPTION OF THE INVENTION

The detailed description is given below according to the figures and embodiments.

Figure 1:
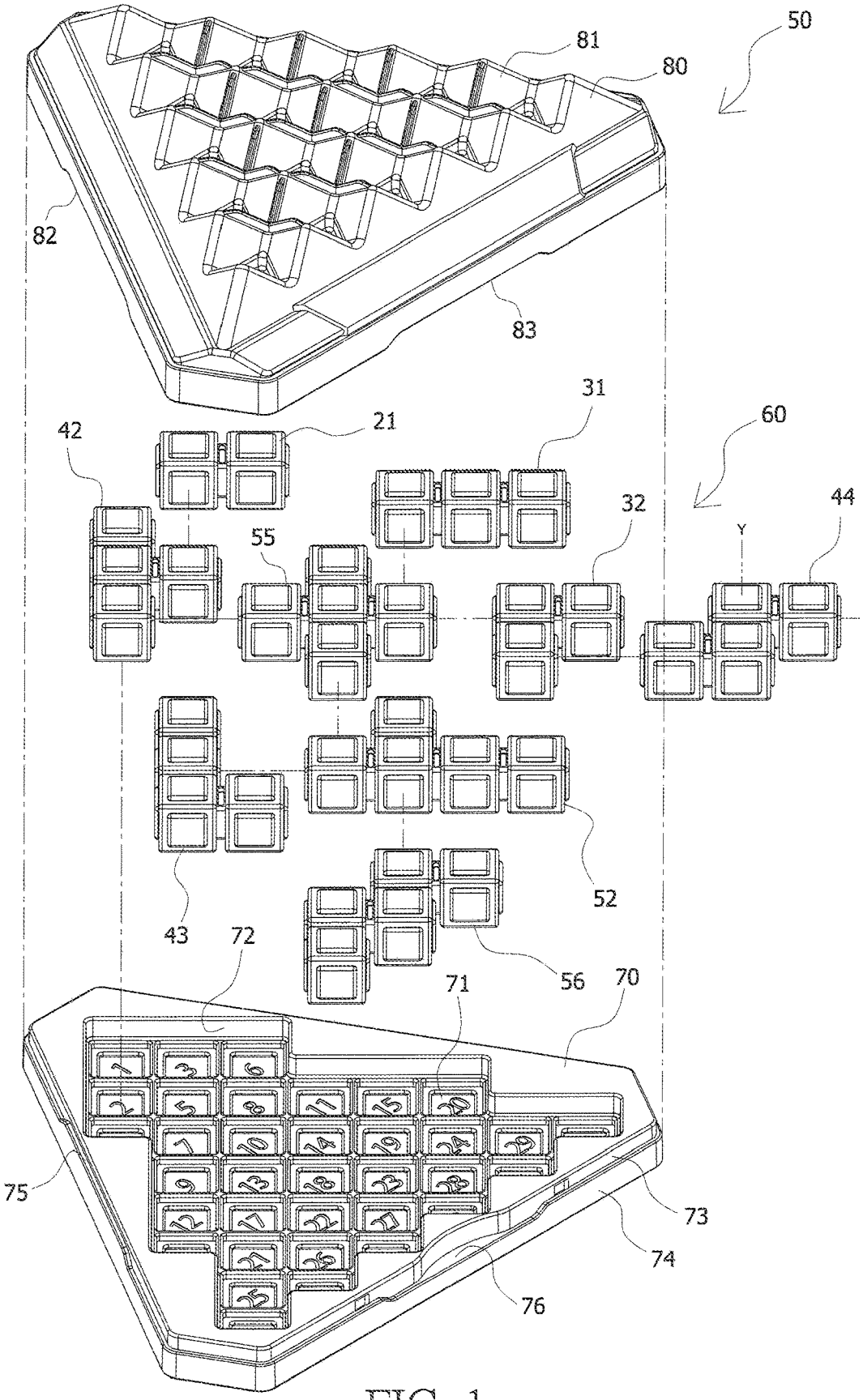
FIG. 1 is a three-dimensional exploded diagram of building block device of the present invention.

FIG. 1 discloses a building block device, including a storage box 50 and a building block group 60, wherein the storage box 50 comprises a base 70 and a top cover 80 covering the base 70. the building block group 60 comprises multiple building blocks. The base 70 has a storage tank 72 for holding the building block group 60. The top cover 80 can cover the base 70 to conceal the building block group 60. The bottom of the storage tank 72 is provided with 35 locating grids 71 for the building block group 60 to form a single-layer planar pattern. The surface of the top cover 80 is provided with 15 locating slots 81 for the building block group 60 to stack a five-layer trilateral cone shape. Each building block of the building block group 60 comprises one to five units, the units are connected at two-dimensional angles of horizontal X or vertical Y, the building block group 60 has 35 units.

When the building block unit of building block group 60 is a cube, the locating grid 71 is square, it has a quadrate bottom. The locating slot 81 is hexagonal, it comprises a triangular bottom 811 and three bevel faces 812 surrounding the bottom 811. If the building block unit of building block group 60 is spherical, the locating grid 71 must be a semicircular pit, and the locating slot 81 is a semicircular pit. The quadrate shape has better esthetics, smoothness and regularity than spherical shape.

Figure 2:
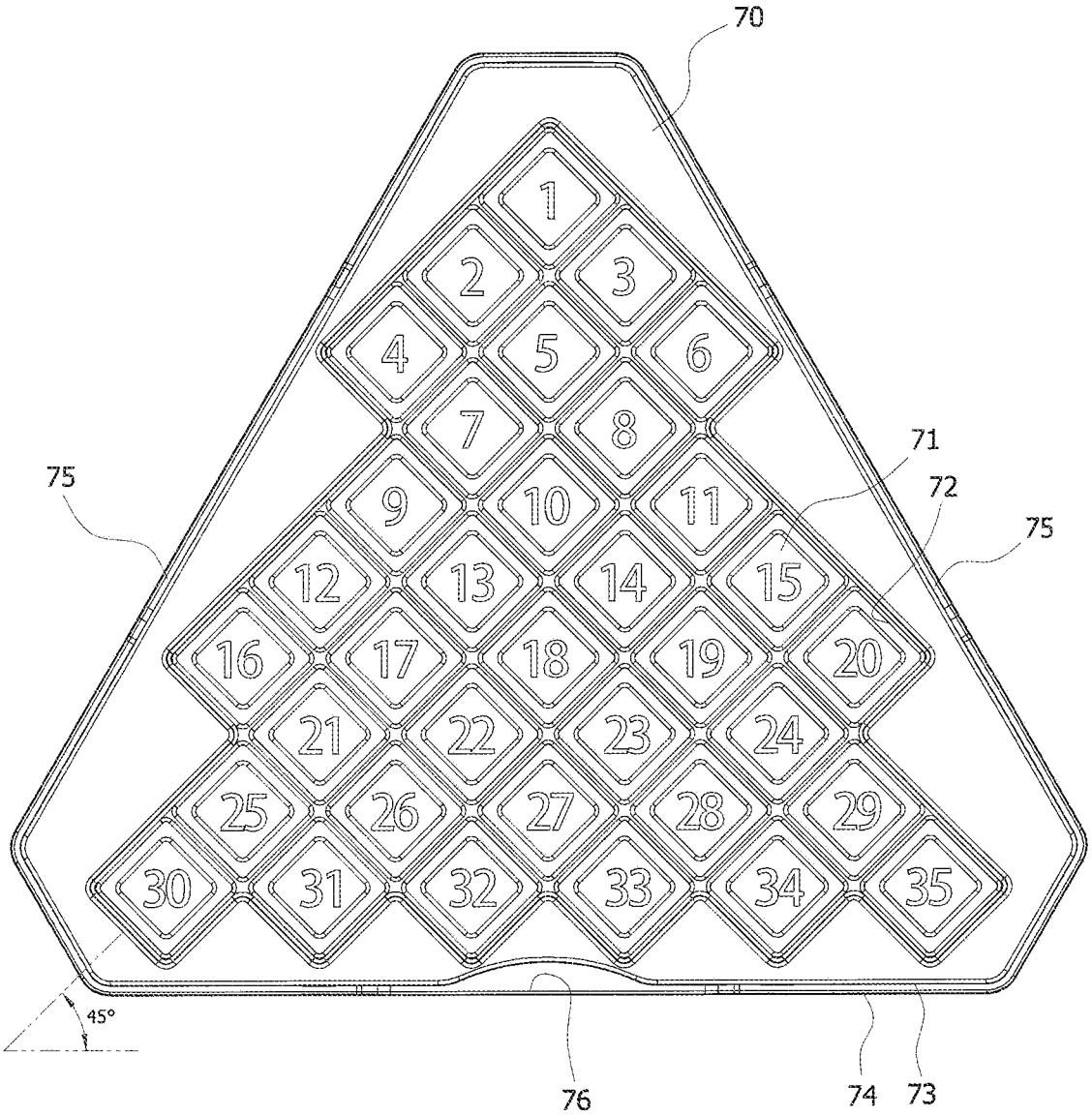
FIG. 2 is a top view of the base in FIG. 1.
Figure 3:
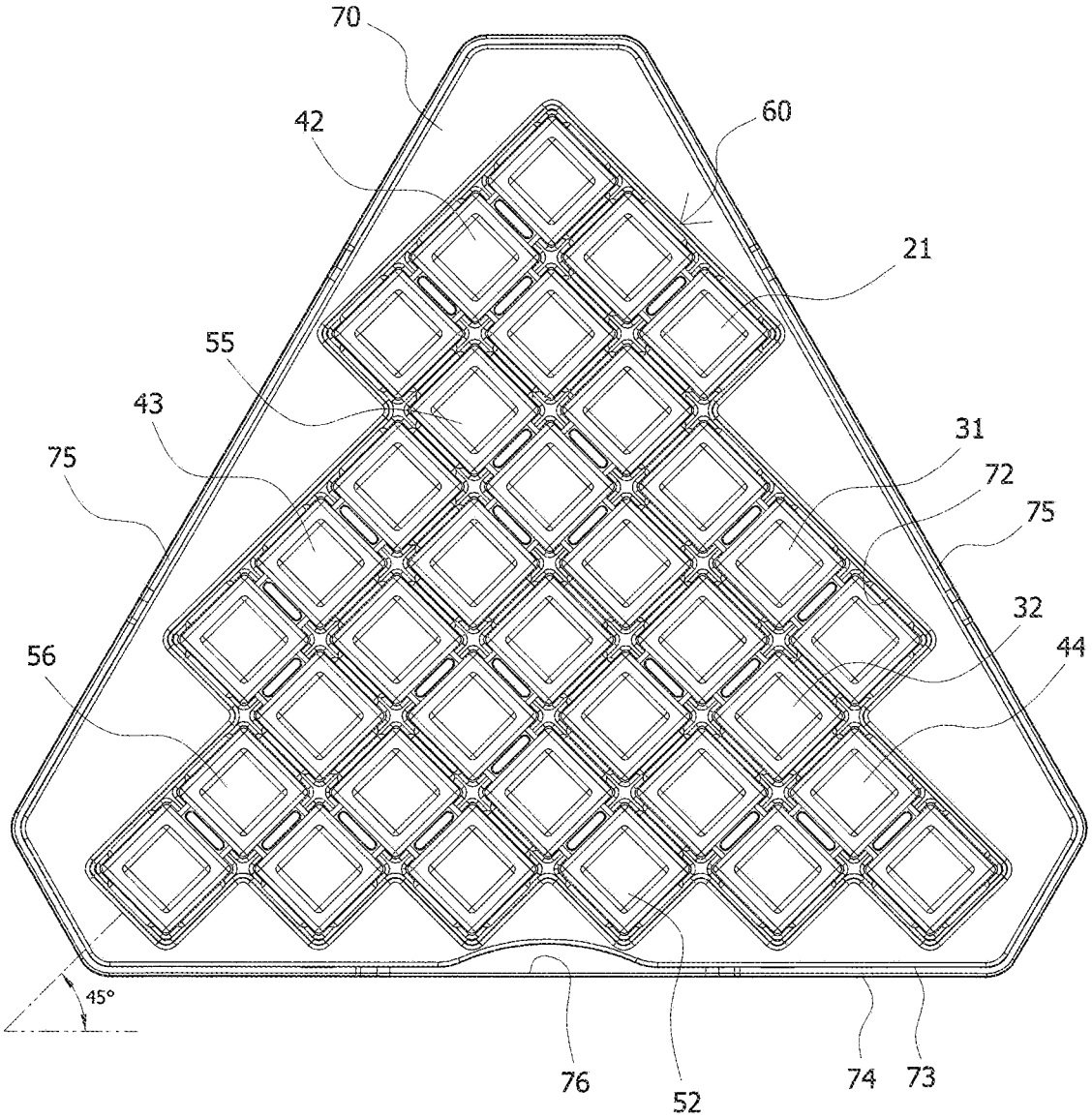
FIG. 3 is a stereogram of building block group assembled on the base.

As shown in FIGS. 1, 2 and 3, the base 70 is trilateral, there are ten rows of the locating grid 71 from top to bottom, including one grid in the first row, two grids in the second row, three grids in the third row, two grids in the fourth row, three grids in the fifth row, four grids in the sixth row, five grids in the seventh row, four grids in the eighth row, five grids in the ninth row, six grids in the tenth row, the grid edges of upper and lower locating grids 71 abut on each other at 45°, the grid corners of left and right locating grids 71 abut on each other at a horizontal angle. The building blocks of the building block group 60 are inserted respectively according to the positions of locating grids 71, the single-layer planar pattern is assembled at last.

Figure 4:
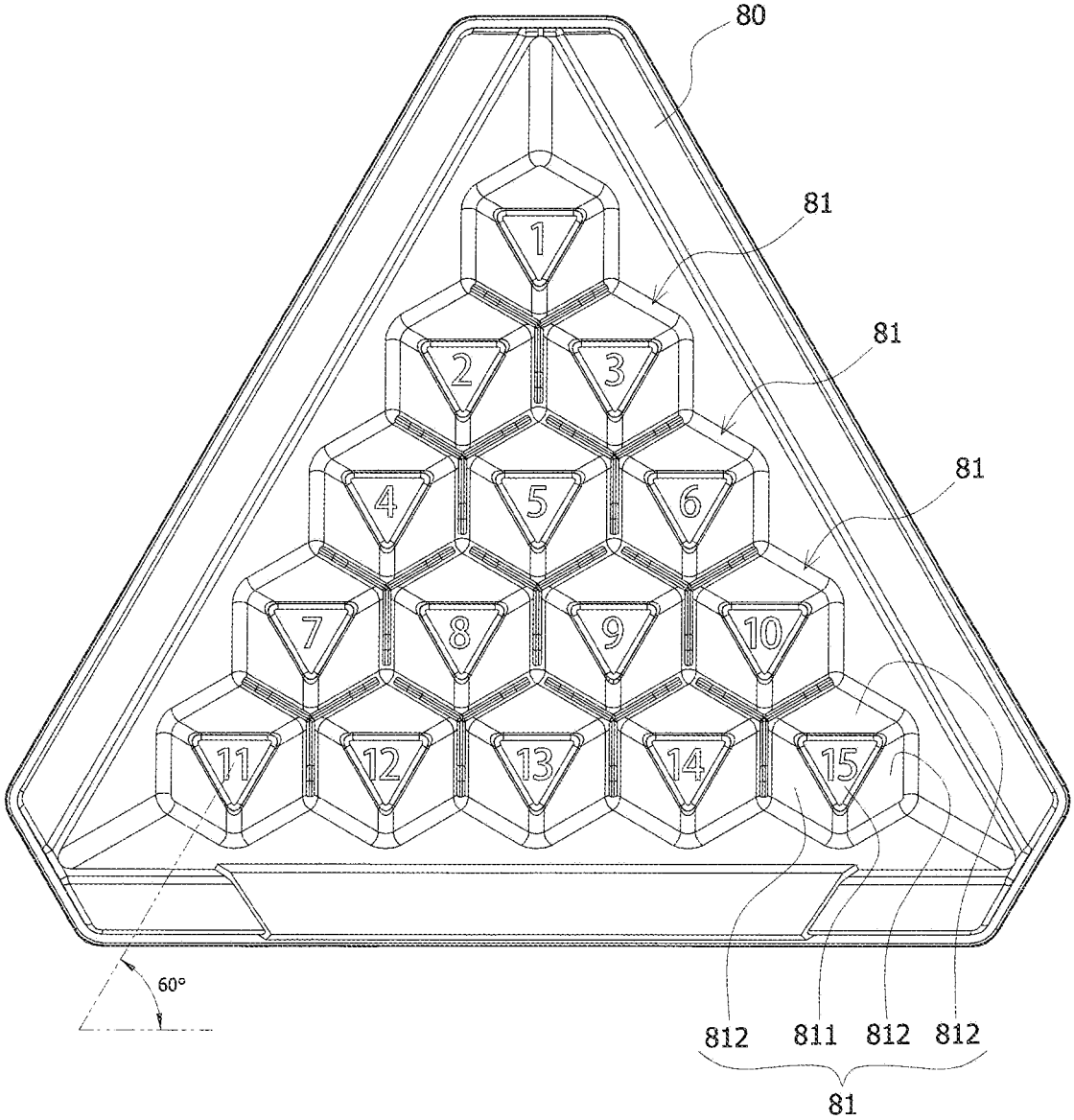
FIG. 4 is a top view of the top cover in FIG. 1.
Figure 5:
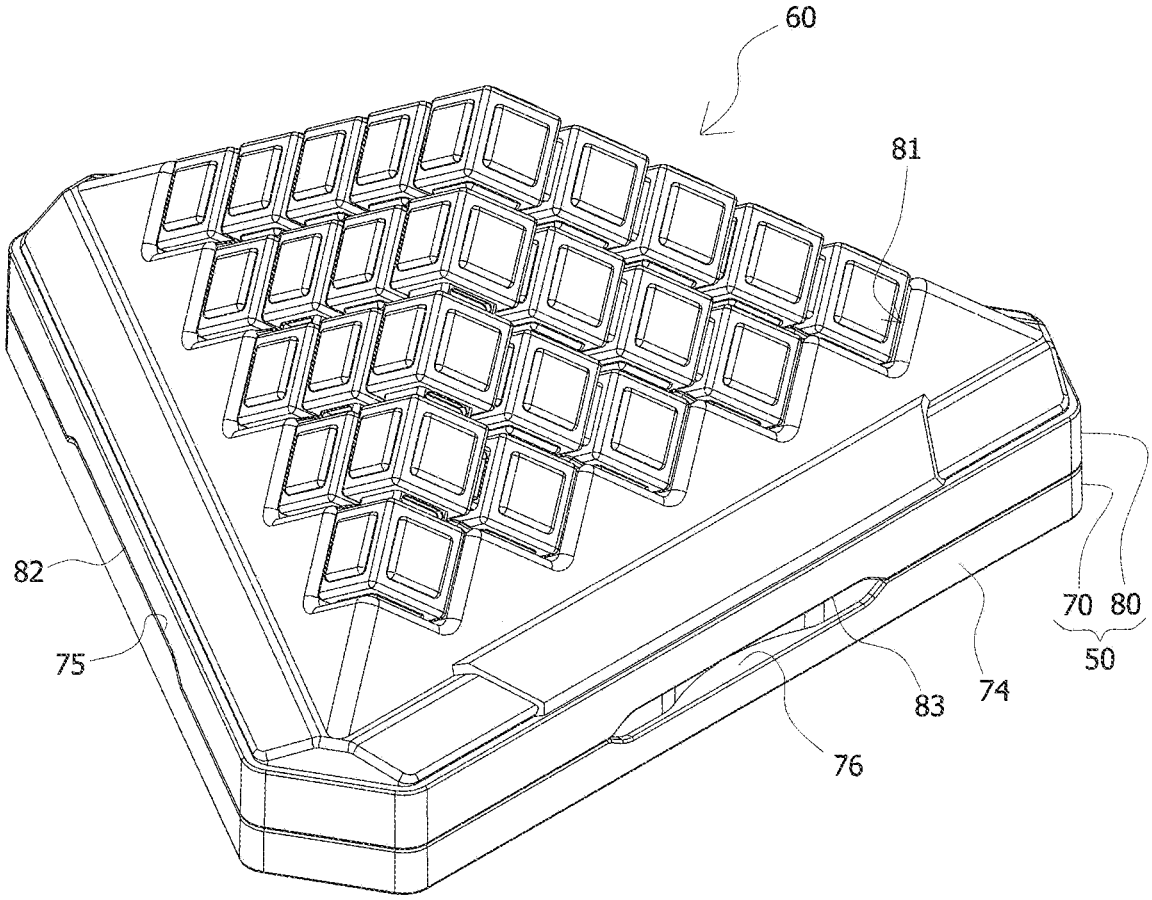
FIG. 5 is a stereogram of building block group stacked on the top cover.

As shown in FIGS. 1, 4 and 5, the top cover 80 is trilateral, each side is provided with five locating slots 81, and there are five rows of the locating slot 81 from top to bottom, including one slot in the first row, two slots in the second row, three slots in the third row, four slots in the fourth row and five slots in the fifth row. The slot edges of the upper and lower locating slots 81 abut on each other at 60°, the slot edges of left and right locating slots 81 abut on each other at a horizontal angle. The building blocks of the building block group 60 are inserted respectively according to the positions of locating slots 81, a pyramid-like five-layer trilateral cone shape can be stacked up at last.

Figure 6:
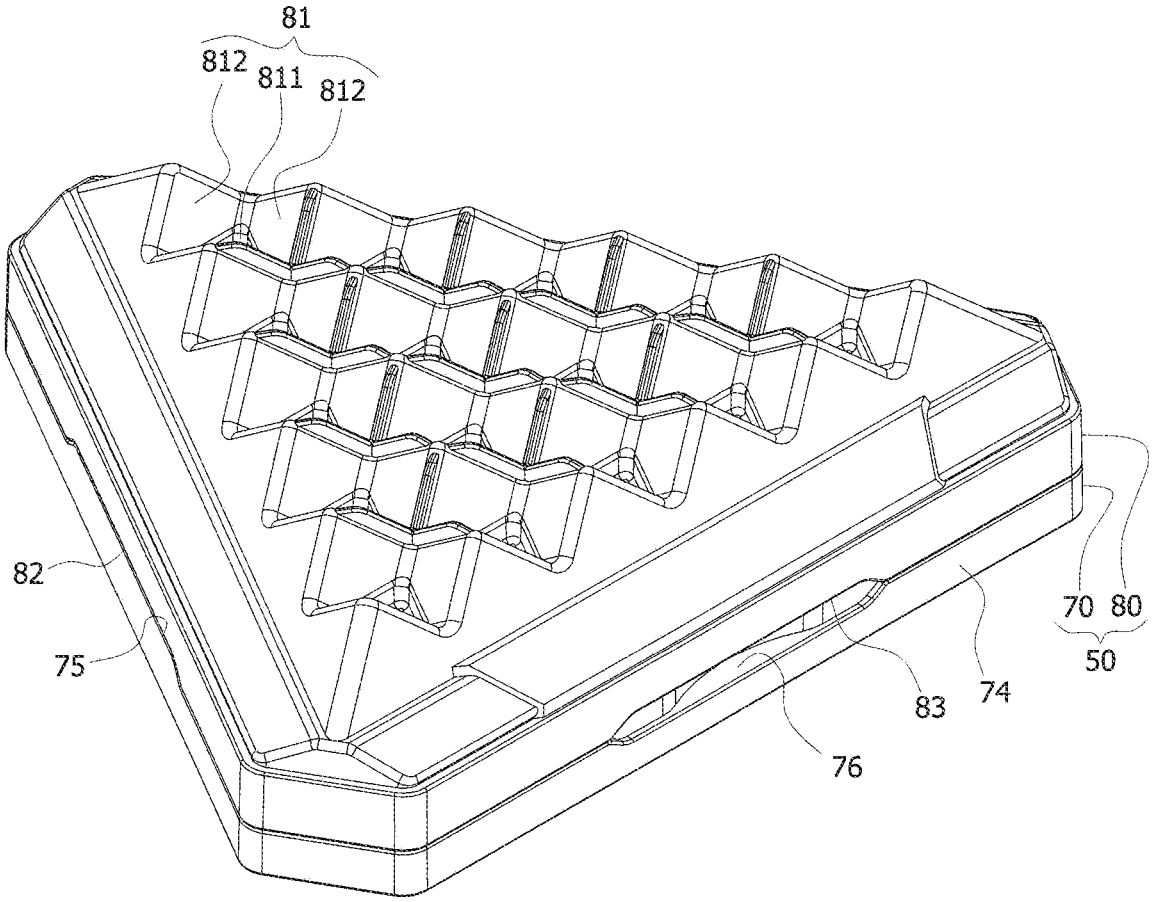
FIG. 6 is a stereogram of storage box assembled of top cover and base.

As shown in FIGS. 1 and 6, the base 70 is trilateral, including an upper layer 73 and a lower layer 74, the lower layer 74 has larger outside diameter than the upper layer 73, presenting a steplike periphery, the lower layers 74 of the first and second sides are connected to long convex edges 75, the lower layer 74 of the third side forms a short notch 76, the two long convex edges 75 are longer than the short notch 76. In addition, the shape of the top cover 80 is identical with the base 70, two side edges are provided with long notches 82, the other side edge is provided with a short notch 83, the two long notches 82 are longer than the short notch 83. The bottom surface of the top cover 80 coves to wrap the upper layer 73 of base 70, and the bottom edge can be put on the top edge of lower layer 74 of base 70. The two long notches 82 of top cover 80 can match the two long convex edges 75 of base 70 without gaps. The short notch 83 and the short notch 76 of the base 70 are vertically symmetrical to form an open gap. This design is like a foolproof structure, allowing the user to complete operation accurately according to intuition, avoiding misplacing the top cover 80 on the base 70.

In order to reduce the overall weight, the base 70 and top cover 80 are changed to hollow plastic shells instead of solid plates, especially the top cover 80, its bottom surface is inwardly dished, when the top cover 80 covers the base 70, it wraps the upper layer 73 of base 70, and the peripheral bottom edge is closed with the top edge of lower layer 74 of base 70, so as to stabilize the covering. In addition, each unit of the building blocks of the building block group 60 is hollow, the units communicate with each other, so the weight is reduced a lot compared with the old type of building blocks, the consumption of plastics is reduced, and the manufacturing cost is reduced.

Figure 7:
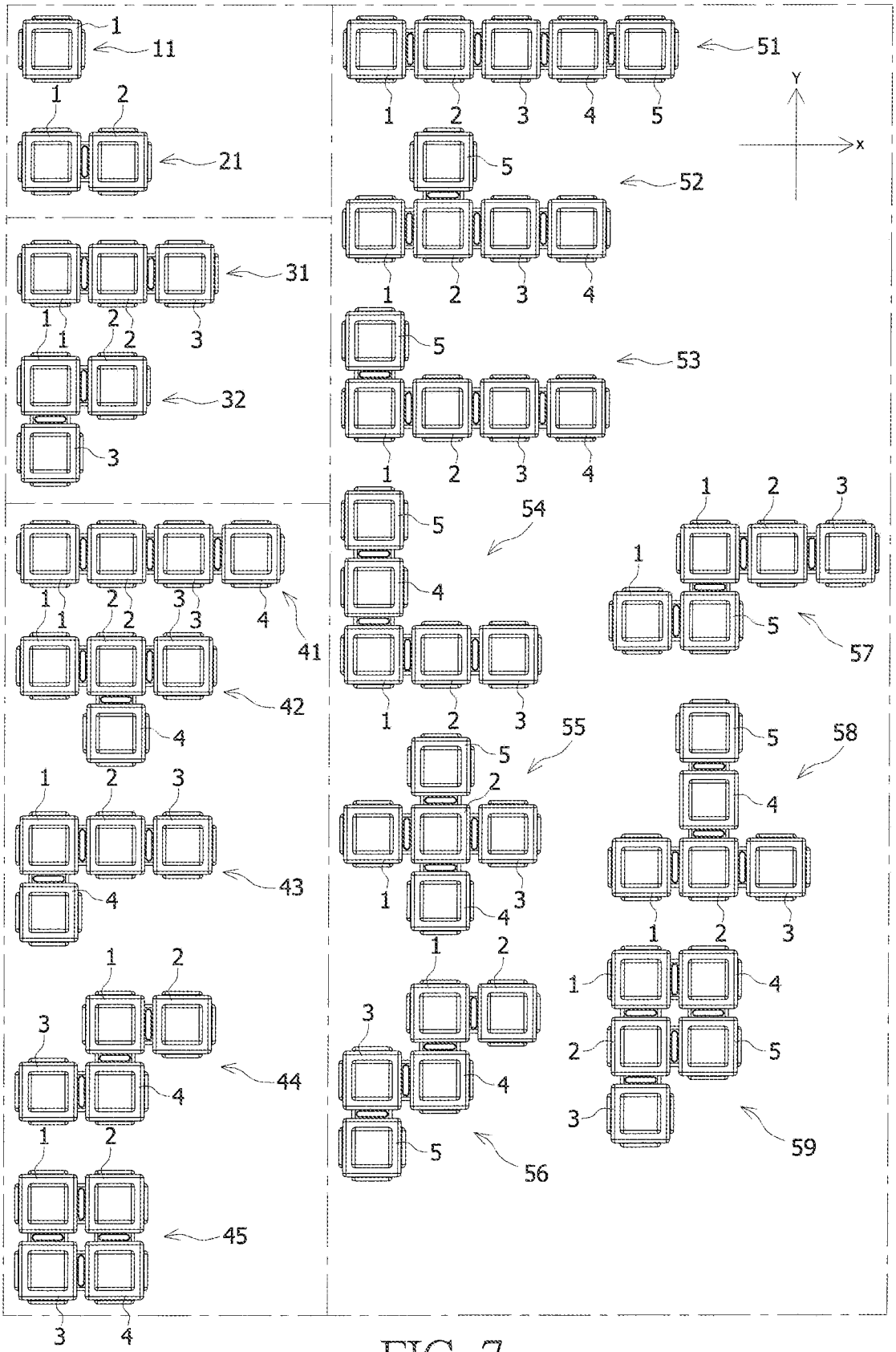
FIG. 7 is a schematic diagram of building block group of the present invention selected from 18 building blocks.

As shown in FIG. 7, the building block group 60 of the present invention comprises multiple building blocks, selected from 18 building blocks of the following Units 1~5, including Unit 1; one piece, building block 11;

Unit 2: one piece, building block 21, Units 1 and 2 are horizontally connected;

Unit 3: two pieces, including

No. 1, building block 31, Units 1, 2 and 3 are horizontally connected;

No. 2, building block 32, Units 1 and 2 are horizontally connected, Units 1 and 3 are vertically connected;

Unit 4: five pieces, including

No. 1, building block 41, Units 1, 2, 3 and 4 are horizontally connected;

No. 2, building block 42, Units 1, 2 and 3 are horizontally connected, Units 2 and 4 are vertically connected;

No. 3, building block 43, Units 1, 2 and 3 are horizontally connected, Units 3 and 4 are vertically connected;

No. 4, building block 44, Units 1 and 2 are horizontally connected, Units 3 and 4 are horizontally connected, Units 1 and 4 are vertically connected;

No. 5, building block 45, Units 1 and 2 are horizontally connected, Units 3 and 4 are horizontally connected; Units 1 and 3 are vertically connected, Units 2 and 4 are vertically connected;

Unit 5: nine pieces, including:

No. 1, building block 51, Units 1, 2, 3, 4 and 5 are horizontally connected;

No. 2, building block 52, Units 1, 2, 3 and 4 are horizontally connected, Units 2 and 5 are vertically connected;

No. 3, building block 53, Units 1, 2, 3 and 4 are horizontally connected, Units 1 and 5 are vertically connected;

No. 4, building block 54, Units 1, 2 and 3 are horizontally connected, Units 1, 4 and 5 are vertically connected;

No. 5, building block 55, Units 1, 2 and 3 are horizontally connected, Units 4, 2 and 5 are vertically connected;

No. 6, building block 56, Units 1 and 2 are horizontally connected, Units 3 and 4 are horizontally connected, Units 1 and 4 are vertically connected, Units 3 and 5 are vertically connected;

No. 7, building block 57, Units 1, 2 and 3 are horizontally connected, Units 4 and 5 are horizontally connected, Units 1 and 5 are vertically connected;

No. 8, building block 58, Units 1, 2 and 3 are horizontally connected, Units 2, 4 and 5 are vertically connected;

No. 9, building block 59, Units 1, 2 and 3 are vertically connected, Units 4 and 5 are vertically connected, Units 1 and 4 are horizontally connected, Units 2 and 5 are horizontally connected.

Figure 8:
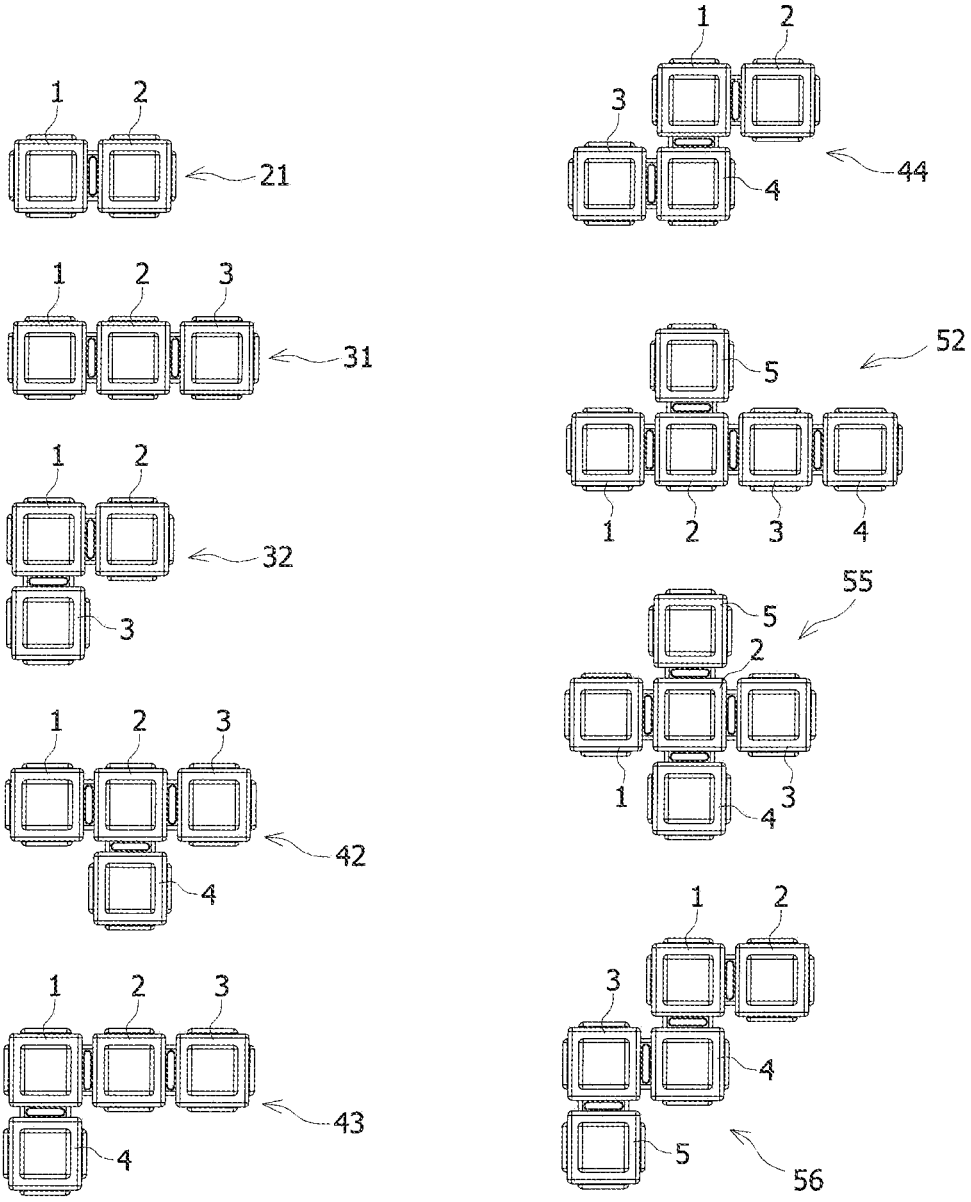
FIG. 8 is a schematic diagram of building block group in the Embodiment 1 of the present invention.

FIG. 8 discloses the building block group in the first embodiment of the present invention, including 9 pieces selected from the 18 building blocks, there are 35 units, which are The first building block: building block 21 of Unit 2;

The second and third building blocks: building blocks 31, 32 of Unit 3;

The fourth, fifth and sixth building blocks: building blocks of Unit 4, e.g. three random building blocks 42, 43, 44 disclosed in the figures;

The seventh, eighth and ninth building blocks: building blocks of Unit 5, e.g. three random building blocks 52, 55, 56 disclosed in the figures.

The following table shows the unit allocation of nine building blocks:

| Name of building block | Qty | Unit | Total number of units |
|---|---|---|---|
| The first building block | 1 | 2 | 2 |
| The second and third building blocks | 2 | 3 | 6 |
| The fourth, fifth and sixth building blocks | 3 | 4 | 12 |
| The seventh, eighth and ninth building blocks | 3 | 5 | 15 |
| Total | 9 | | 35 |

Figure 9:
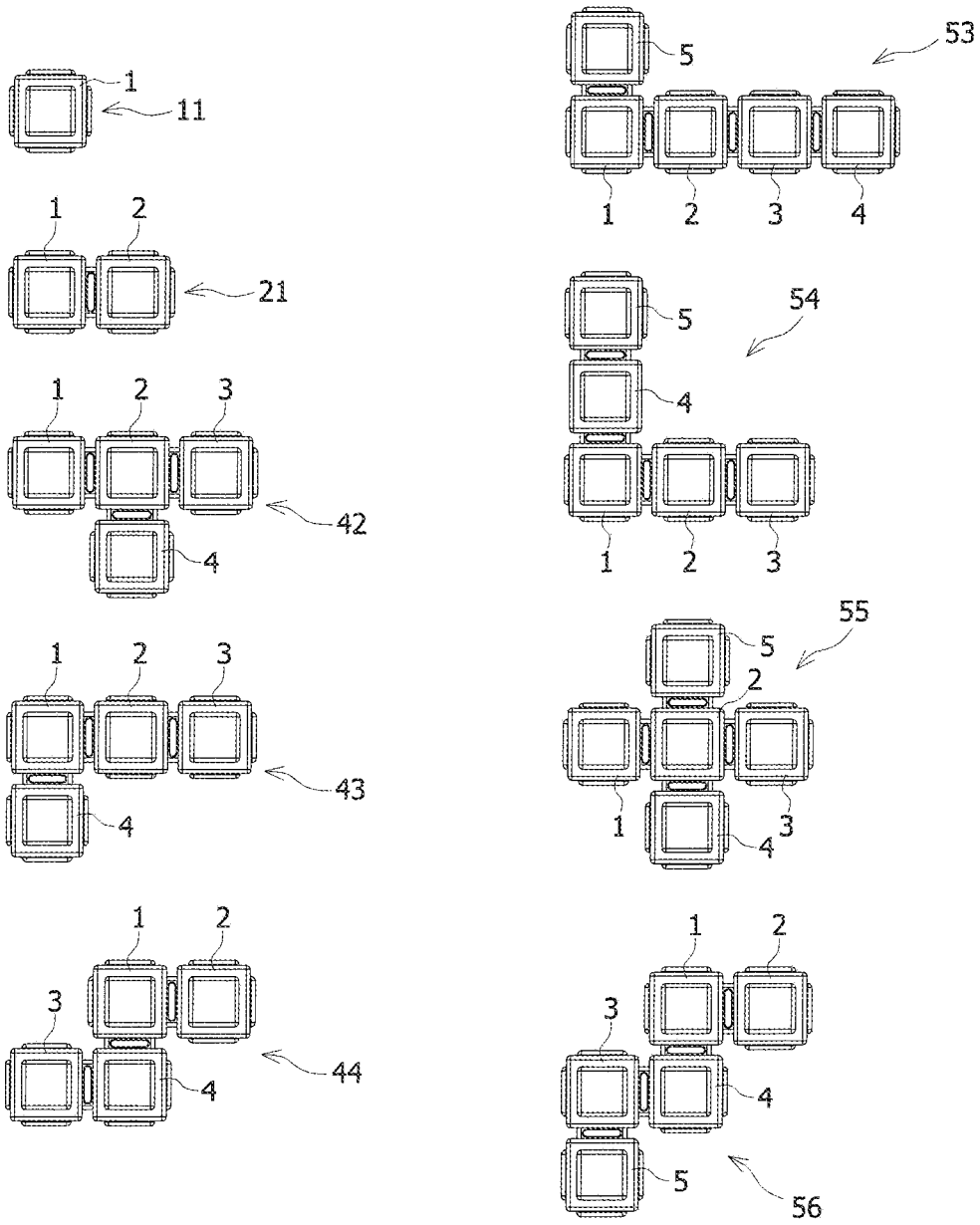
FIG. 9 is a schematic diagram of building block group in the Embodiment 2 of the present invention.

FIG. 9 discloses the building block group in the second embodiment of the present invention, including 9 pieces selected from the 18 building blocks, there are 35 units, which are The first building block: building block 11 of Unit 1;

The second building block: building block 21 of Unit 2;

The third, fourth and fifth building blocks: building blocks of Unit 4, e.g. three random building blocks 42, 43, 44 disclosed in the figures;

The sixth, seventh, eighth and ninth building blocks: building blocks of Unit 5, e.g. four random building blocks 53, 54, 55, 56 disclosed in the figures.

The following table shows the unit allocation of nine building blocks:

| Name of building block | Qty | Unit | Total number of units |
|---|---|---|---|
| The first building block | 1 | 1 | 1 |
| The second building block | 1 | 2 | 2 |
| The third, fourth and fifth building blocks | 3 | 4 | 12 |
| The sixth, seventh, eighth and ninth building blocks | 4 | 5 | 20 |
| Total | 9 | | 35 |

Figure 10:
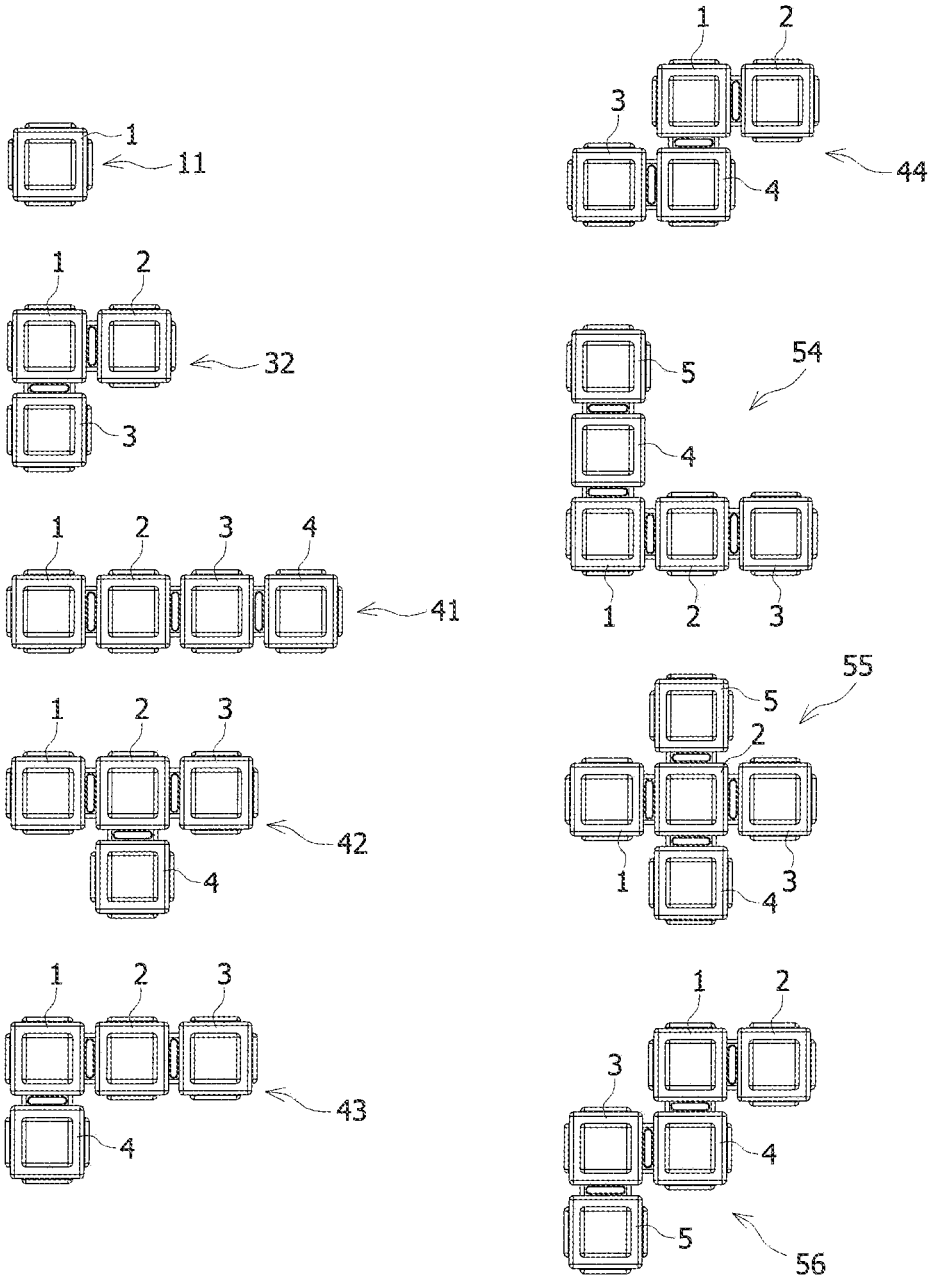
FIG. 10 is a schematic diagram of building block group in the Embodiment 3 of the present invention.

FIG. 10 discloses the building block group in the third embodiment of the present invention, including 9 pieces selected from the 18 building blocks, there are 35 units, which are The first building block: building block 11 of Unit 1;

The second building block: building block of Unit 3, e.g. one random building block 32 disclosed in the figures;

The third, fourth, fifth and sixth building blocks: building blocks of Unit 4, e.g. four random building blocks 41, 42, 43, 44 disclosed in the figures;

The seventh, eighth and ninth building blocks: building blocks of Unit 5, e.g. three random building blocks 54, 55, 56 disclosed in the figures.

The following table shows the unit allocation of nine building blocks:

| Name of building block | Qty | Unit | Total number of units |
|---|---|---|---|
| The first building block | 1 | 1 | 1 |
| The second building block | 1 | 3 | 3 |
| The third, fourth, fifth and sixth building blocks | 4 | 4 | 16 |
| The seventh, eighth and ninth building blocks | 3 | 5 | 15 |
| Total | 9 | | 35 |

Figure 11:
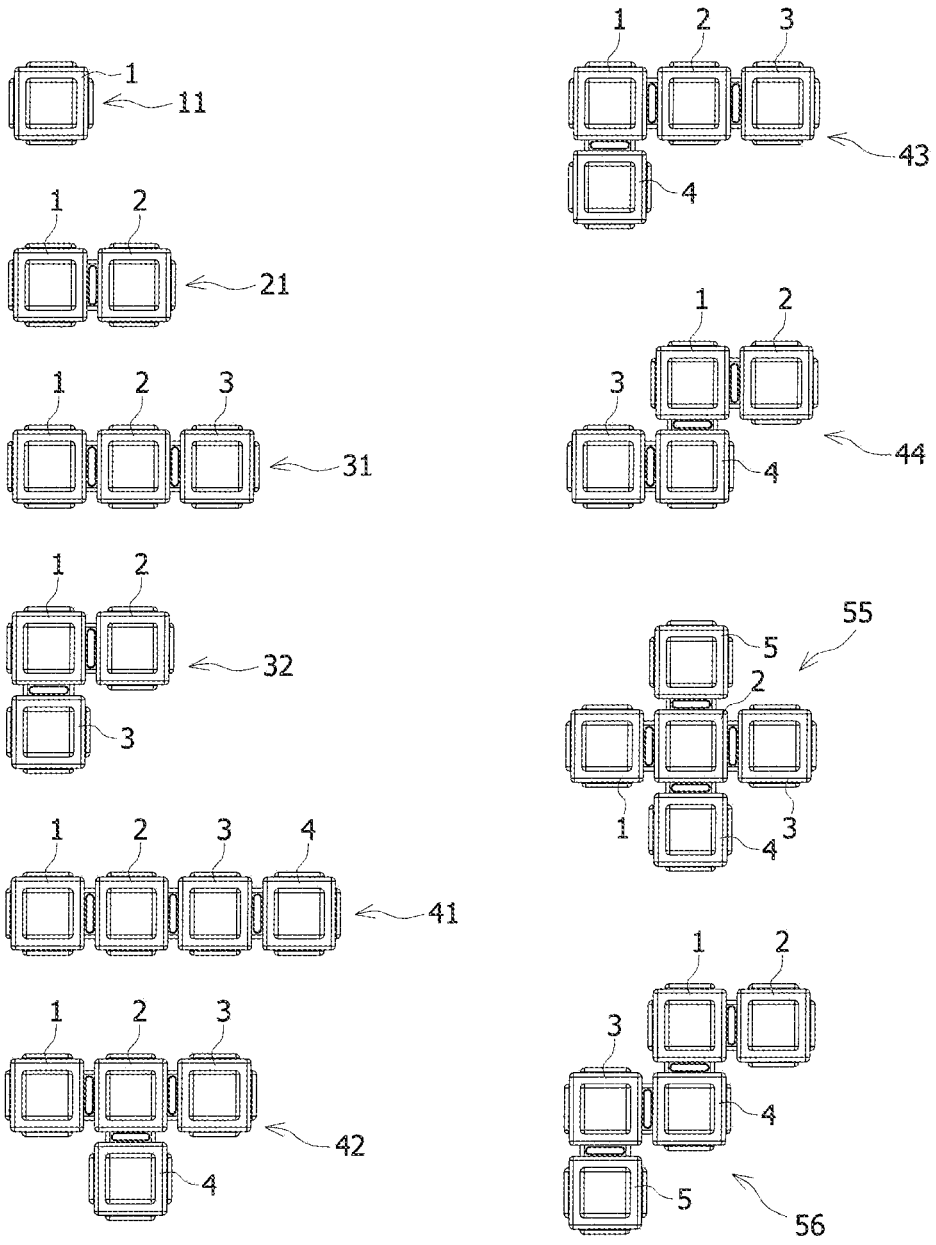
FIG. 11 is a schematic diagram of building block group in the Embodiment 4 of the present invention.

FIG. 11 discloses the building block group in the fourth embodiment of the present invention, including 10 pieces selected from the 18 building blocks, there are 35 units, which are The first building block: building block 11 of Unit 1;

The second building block: building block 21 of Unit 2;

The third and fourth building blocks: building blocks 31, 32 of Unit 3;

The fifth, sixth, seventh and eighth building blocks: building blocks of Unit 4, e.g. four random building blocks 41, 42, 43, 44 disclosed in the figures;

The ninth and tenth building blocks: building blocks of Unit 5, e.g. two random building blocks 55, 56 disclosed in the figures.

The following table shows the unit allocation of 10 building blocks:

| Name of building block | Qty | Unit | Total number of units |
|---|---|---|---|
| The first building block | 1 | 1 | 1 |
| The second building block | 1 | 2 | 2 |
| The third and fourth building blocks | 2 | 3 | 6 |

-continued

| Name of building block | Qty | Unit | Total number of units |
|---|---|---|---|
| The fifth, sixth, seventh and eighth building blocks | 4 | 4 | 16 |
| The ninth and tenth building blocks | 2 | 5 | 10 |
| Total | 10 | | 35 |

To sum up, based on the technical means of the present invention, the building block group 60 can assemble a single-layer planar pattern on the base 70, and can stack up a five-layer trilateral cone on the top cover 80, the base 70 and top cover 80 can form a storage box 50 for the building block group 60, the building block group 60 can be stored completely to avoid losing building blocks, and the small box body does not occupy much space, it is portable. In addition, a foolproof structure is arranged between top cover 80 and base 70 to avoid misplacing the top cover 80 on the base 70. The building block group 60 comprises 9 or 10 building blocks, it is different from prior combinations, there will be new plays and new solutions, and the users' interest in the game can be enhanced. Furthermore, the building block group 60, base 70 and top cover 80 are hollow structures, the weight is reduced a lot, meeting the environmental requirement.

I claim:

1. A building block device with 35 units as variable combinations, including a storage box (50) and a building block group (60), wherein the storage box (50) includes a base (70) and a top cover (80) covering the base (70);

the building block group (60) includes a plurality of building blocks, the base (70) has a storage tank (72) for placing the building block group (60), the top cover (80) can cover the base (70) to conceal the building block group (60);

a bottom of the storage tank (72) is provided with 35 locating grids (71) for the building block group (60) to be arranged into a single-layer flat pattern, a surface of the top cover (80) is provided with 15 locating slots (81) for the building block group (60) to stack up a five-layer trilateral cone, units of the building block group (60) composed of one to five units connected by a two-dimensional angle in a horizontal or vertical direction; and a total of 35 units in the block 60;

wherein building units of the building block group (60) are three-dimensional squares, each of the 35 locating grids (71) has a square groove bottom; the shape of the locating slot (81) is a hexagon, which is composed of a triangular bottom (811) and three inclined planes (812) around the bottom (811);

wherein the base (70) is triangular and the 35 locating grids (71) are arranged in ten rows from top to bottom, with a first row having 1 grid, a second row having 2 grids, a third row having 3 grids, a fourth row having 2 grids, a fifth row having 3 grids, a sixth row having 4 grids, a seventh row having 5 grids, a eighth row having 4 grids, a ninth row having 5 grids, and a tenth row having 6 grids, each upper-row locating grid of the 35 locating grids (35) is adjacent to each lower-row locating grid at a 45-degree angle, and each adjacent locating grid in the same row is adjacent to each other at a horizontal angle.

2. The building block device defined in claim 1, wherein the top cover (80) is in a triangular shape, with 5 locating slots (81) on each side; the locating slots (81) are arranged in five rows from top to bottom, with 1 slot in a first row, 2 slots in a second row, 3 slots in a third row, 4 slots in a fourth row, and 5 slots in a fifth row, the locating slots (81) in each row are adjacent to each other at a 60-degree angle, and left and right locating slots (81) in each row are adjacent to each other at a horizontal angle.

3. The building block device defined in claim 1, wherein the 35 building block units comprise nine building blocks, including:

a first building block: building block of Unit 2;

second and third building blocks: building block of Unit 3;

fourth, fifth and sixth building blocks: building blocks of Unit 4; and seventh, eighth and ninth building blocks: building blocks of Unit 5.

4. The building block device defined in claim 1, wherein the 35 building block units comprise nine building blocks, including:

a first building block: building block of Unit 1;

a second building block: building block of Unit 2;

third, fourth and fifth building blocks: building blocks of Unit 4; and sixth, seventh, eighth and ninth building blocks: building blocks of Unit 5.

5. The building block device defined in claim 1, wherein the 35 building block units comprise nine building blocks, including:

a first building block: building block of Unit 1;

a second building block: building block of Unit 3;

third, fourth, fifth and sixth building blocks: building blocks of Unit 4; and seventh, eighth and ninth building blocks: building blocks of Unit 5.

6. The building block device defined in claim 1 wherein the 35 building block units comprise 10 building blocks, including:

a first building block: building block of Unit 1;

a second building block: building block of Unit 2;

third and fourth building blocks: building blocks of Unit 3; and fifth, sixth, seventh and eighth building blocks: building blocks of Unit 4; and ninth and tenth building blocks: building blocks of Unit 5.

7. The building block device defined in claim 1, wherein the building blocks are selected from Units 1 to 5, including Unit 1; one piece, building block (11)

Unit 2: one piece, building block (21), Units 1 and 2 are horizontally connected;

Unit 3: two pieces, including

No. 1, building block (31), Units 1, 2 and 3 are horizontally connected;

No. 2, building block (32), Units 1 and 2 are horizontally connected, Units 1 and 3 are vertically connected;

Unit 4: five pieces, including

No. 1, building block (41), Units 1, 2, 3 and 4 are horizontally connected;

No. 2, building block (42), Units 1, 2 and 3 are horizontally connected, Units 2 and 4 are vertically connected;

No. 3, building block (43), Units 1, 2 and 3 are horizontally connected, Units 1 and 4 are vertically connected;

No. 4, building block (44), Units 1 and 2 are horizontally connected, Units 3 and 4 are horizontally connected, Units 1 and 4 are vertically connected;

No. 5, building block (45), Units 1 and 2 are horizontally connected, Units 3 and 4 are horizontally connected; Units 1 and 3 are vertically connected, Units 2 and 4 are vertically connected;

Unit 5: nine pieces, including:

No. 1, building block (51), Units 1, 2, 3, 4 and 5 are horizontally connected;

No. 2, building block (52), Units 1, 2, 3 and 4 are horizontally connected, Units 2 and 5 are vertically connected;

No. 3, building block (53), Units 1, 2, 3 and 4 are horizontally connected, Units 1 and 5 are vertically connected;

No. 4, building block (54), Units 1, 2 and 3 are horizontally connected, Units 1, 4 and 5 are vertically connected;

No. 5, building block (55), Units 1, 2 and 3 are horizontally connected, Units 4, 2 and 5 are vertically connected;

No. 6, building block (56), Units 1 and 2 are horizontally connected, Units 3 and 4 are horizontally connected, Units 1 and 4 are vertically connected, Units 3 and 5 are vertically connected;

No. 7, building block (57), Units 1, 2 and 3 are horizontally connected, Units 4 and 5 are horizontally connected, Units 1 and 5 are vertically connected;

No. 8, building block (58), Units 1, 2 and 3 are horizontally connected, Units 2, 4 and 5 are vertically connected;

No. 9, building block (59), Units 1, 2 and 3 are vertically connected, Units 4 and 5 are vertically connected, Units 1 and 4 are horizontally connected, Units 2 and 5 are horizontally connected.

8. The building block device defined in claim 1, wherein the base (70) is divided into an upper layer (73) and a lower layer (74), the lower layer (74) has larger outside diameter than the upper layer (73), presenting a step periphery, the lower layers (74) of first and second sides are connected to long convex edges (75), the lower layer (74) of a third side forms a short notch (76), two long convex edges (75) are longer than the short notch (76); moreover, a shape of the top cover (80) is identical with the base (70), bottom edges of two sides are provided with long notches (82), a bottom edge of the other side is provided with a short notch (83), the two long notches (82) are longer than the short notch (83); the bottom surface of the top cover (80) coves to wrap the upper layer (73) of base (70), and the bottom edge can be put on a top edge of lower layer (74) of base (70), the two long notches (82) of top cover (80) can match the two long convex edges (75) of base (70) without gaps, the short notch (83) and the short notch (76) of the base (70) are vertically symmetrical to form an open gap.

* * * * *